US006681022B1

(12) United States Patent
Puthuff et al.

(10) Patent No.: US 6,681,022 B1
(45) **Date of Patent: *Jan. 20, 2004**

(54) TWO-WAY COMMUNICATION EARPIECE

(75) Inventors: Steven H. Puthuff, Saratoga, CA (US); Patrick A. Mavrakis, Newark, CA (US); Jon C. Taenzer, Los Altos, CA (US); David L. Luger, Foster City, CA (US); William N. Buchele, Los Gatos, CA (US)

(73) Assignee: GN ReSound North Amerca Corporation, Redwood City, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/121,208

(22) Filed: Jul. 22, 1998

(51) Int. Cl.[7] ..... H04R 25/00

(52) U.S. Cl. ..... 381/338; 381/375; 381/376; 381/381; 381/315; 379/436; 379/431; 455/100

(58) Field of Search ..... 381/370, 374, 381/375, 376, 381, 382, 384, 312, 313, 315, 330, 355, 359, 361, 365, 367, 122, 338, 380, 328; 379/436, 431; 455/100; 181/129, 130, 135

(56) References Cited

U.S. PATENT DOCUMENTS

| | | | | | |
|---|---|---|---|---|---|
| 3,536,861 | A | | 10/1970 | Dulavy | |
| 3,610,841 | A | * | 10/1971 | Hutchings | 381/375 |
| 3,781,492 | A | * | 12/1973 | Cragg et al. | 381/370 |
| 3,934,100 | A | * | 1/1976 | Harada | |
| 3,975,599 | A | | 8/1976 | Johanson | |
| 3,983,336 | A | | 9/1976 | Malek et al. | |
| 4,090,040 | A | | 5/1978 | Berland | |
| 4,392,025 | A | * | 7/1983 | Tamamura et al. | |
| 4,450,930 | A | | 5/1984 | Killion | |
| 4,540,063 | A | * | 9/1985 | Ochi | |
| 4,570,746 | A | | 2/1986 | Das et al. | |
| 4,720,857 | A | * | 1/1988 | Burris et al. | 379/430 |
| 4,751,738 | A | | 6/1988 | Widrow et al. | |
| 4,869,339 | A | | 9/1989 | Barton | |
| 4,904,078 | A | | 2/1990 | Gorike | |
| 5,031,219 | A | | 7/1991 | Ward et al. | |
| 5,033,090 | A | | 7/1991 | Weinrich et al. | |
| 5,113,967 | A | * | 5/1992 | Killion | |
| 5,201,006 | A | | 4/1993 | Weinrich | |
| 5,201,007 | A | | 4/1993 | Ward et al. | |
| 5,249,235 | A | | 9/1993 | Davis, II et al. | |
| 5,276,739 | A | | 1/1994 | Krokstad et al. | |

(List continued on next page.)

OTHER PUBLICATIONS

Jonathan Marshall, "*Whisper–Light Speaker/Microphone Says An Earful*", San Francisco Chronicle, Jul. 14, 1998, 1 page.

(List continued on next page.)

*Primary Examiner*—Curtis Kuntz
*Assistant Examiner*—Dionne N. Harvey
(74) *Attorney, Agent, or Firm*—Bingham McCutchen, LLP; David G. Beck

(57) ABSTRACT

The two-way communication earpiece is a small, inconspicious, and comfortable earpiece which fits behind the ear for sound delivery and pickup. The earpiece may be used with a variety of communication devices, such as telephones, cellular telephones, two-way radios, radios, tape players, CD players, and televisions. The earpiece is configured to be received behind the ear of a user with a sound delivery tube extending from behind the ear into the ear canal of the user. An eartip positioned on the sound delivery tube is preferably a non-occluding type eartip which allows ambient sound to enter the ear canal around the eartip. A microphone is positioned on the earpiece above the ear for voice pickup.

8 Claims, 6 Drawing Sheets

U.S. PATENT DOCUMENTS

| | | | | | |
|---|---|---|---|---|---|
| 5,278,912 | A | | 1/1994 | Waldhauer | |
| 5,365,595 | A | | 11/1994 | Li | |
| 5,488,205 | A | | 1/1996 | Major | |
| 5,488,668 | A | | 1/1996 | Waldhauer | |
| 5,500,902 | A | | 3/1996 | Stockham, Jr. et al. | |
| 5,524,056 | A | | 6/1996 | Killion et al. | |
| 5,627,802 | A | | 5/1997 | Langer | |
| 5,701,355 | A | | 12/1997 | Brannan et al. | |
| 5,737,436 | A | * | 4/1998 | Boyden | 381/187 |
| 5,790,681 | A | * | 8/1998 | Leppalahti | 381/187 |
| 6,009,183 | A | * | 12/1999 | Taenzer | |

OTHER PUBLICATIONS

"*Voiceducer, An Ear Microphone System*", Operating Instructions, Motorola Worldwide System and Aftermarket Products Division, Nov. 1992, pp. 1–10.

Stuart, Mark, "Using Hydrophobic Membranes to Protect Gas Sensors", Sensors, May 1998, pp. 14, 18 and 20.

Harry F. Olson, "*Directional Microphone*", Journal of The Audio engineering Society, pp. 100–101.

Elmer V. Carlson, et al. "*Subminiature Directional Microphones,*" Journal of The Audio Engineering Society, pp. 305–309.

Technical Bulletin, Knowles Electronics, Inc., "*EB Directional Hearing Aid Microphone Application Notes,*"No. TB21, pp. 1–8.

Richard Navarro, et al. "*An Ultrasonic Method of Cleaning Cerumen–Occluded Receivers,*" The Hearing Journal, Jun. 1998, vol. 51, No. 6, p. 62.

Product Marketing Information, "*The Ad–hear™ Wax Guard is the Easiest Way to Keep Your Hearing Aid Clean,*" Hearing Components, Inc.

Product Marketing Information, "*Rid Wax,*" Oto–Med Technologies, Inc., U.S. Pat. No. 5,327,500.

Product Marketing Information, "*Wax Buster,* " Knowles Electronics, Inc.

* cited by examiner

TWO-WAY COMMUNICATION EARPIECE

BACKGROUND OF THE INVENTION

1. Field of the Invention

The invention relates to a two-way communication device, and more particularly, the invention relates to an earpiece which is configured to be received behind the ear of a user for two-way communication.

2. Brief Description of the Related Art

Communication devices such as, telephone headsets, cellular telephone headsets, radio, tape player, and CD player headphones, and other sound transmitting systems may be utilized to deliver electronically transmitted sounds to the ear of the user. Hands free two-way communication devices are used for telephone, two-way radio, and other two-way communication. Some two-way communication systems may also be used by police, firefighters, secret service agents, and the like to receive sound transmissions from a remote location and transmit sound to the remote location.

Known hands free telephone headsets generally include at least one earphone for delivering sounds and a microphone for sound pickup. The microphone is generally positioned near the user's mouth by a microphone boom which extends from the headset. The microphone is designed to pick up the user's voice and minimize pickup of background noise. The headset may be held in place on the head by a headband. Other types of headsets have an ear clip which attaches over the ear eliminating the need for a headband. However, these known headsets generally include a microphone positioned on a microphone boom. The microphone boom or the entire headset may be easily dislodged requiring the user to constantly correct their position. These known headsets are often heavy, cumbersome, bulky, and uncomfortable for long time use. The known headsets are also very noticeable.

Some communication earpieces have been developed which do not include the conventional microphone boom or headband, however, these devices have similar drawbacks. One such earpiece includes an occluding earmold type earpiece which is provided in a few generic sizes and is fitted tightly into the ear to secure the earpiece in place. A microphone of this device extends from the earmold straight out of the ear a distance of about 0.5 to 1.5 inches. This cantilevered microphone positions the microphone away from the user's head but also allows the earpiece to be easily dislodged. This earpiece provides relatively poor quality sound pickup.

An additional communication earpiece includes a sound transducer which is sized to be received in the bowl of the ear for delivery of sound to the ear. A cable extends from the earpiece and a microphone is positioned in a capsule on the cable. The microphone capsule hangs just above the user's collar. The microphone located on the cable provides relatively good quality sound pickup but can easily be caught, causing the earpiece to be dislodged. In addition, since the earpiece rests in the bowl of the ear and is not secured, the earpiece can be easily dislodged when the user moves quickly or bends over.

Each of the types of microphone assemblies for communications earpieces and headsets which have been described above have the drawbacks of 1) visibility of the microphone, and 2) positioning of the microphone at a location which allows the microphone or the entire device to become easily dislodged.

Communication earpieces are also known which employ a vibration transducer to pick up sound through bone conduction. The vibration transducer is positioned close to the head instead of away from the head as with a microphone. The vibration transducer sound pickup systems are useful for noisy environments where the performance of microphones is substantially reduced. However, the sound quality of such a sound transducer system for sound pickup is poor in low noise environments.

Another drawback of conventional telephone or other two-way communication headsets is that an earphone of these devices typically delivers sound to a user's pinna, the outer projecting portion of the ear. The pinna enhances higher frequency components of sound resulting in poor sound quality unless appropriate compensation is made.

Another type of telephone headset includes a flexible tube for transmitting sound from a device clipped on the ear to an eartip positioned within the ear canal. However, the eartip of this device provides an acoustic seal completely occluding the ear canal of the user. Sound delivery systems which block the ear canal cause a problem known as the occlusion effect. The occlusion effect is caused by the increased transmission of sound by bone conduction when the ear canal is blocked and ear conduction is impeded. This occlusion effect results in sounds which are unnatural and uncomfortable for the user. In particular, the user's voice sounds unnaturally louder than normal and lacks clarity. In addition, occlusion of the ear canal can prevent the user of the communication device from hearing important ambient sounds.

Two-way communication devices such as a telephone or two-way radio may operate in a simplex mode, half-duplex mode, or full-duplex mode. In the simplex mode or the half-duplex mode, sounds are transmitted one way at a time allowing only one person to talk at a time. Simplex or half-duplex communications are generally employed for two-way radio communication systems. Two-way radios operating on a single frequency can only transmit sounds one way at a time due to the single frequency. The full-duplex mode allows signals to be transmitted two ways at the same time providing better communication.

Accordingly, it would be desirable to provide a two-way, full-duplex mode communication device which is discrete and comfortable to use, as well as simple and low-cost to manufacture. It would also be desirable to provide such a two-way communication device which does not require a headband to hold the device in place and includes a microphone contained within the behind-the-ear device, without a microphone boom. Further, it would be desirable to provide a two-way communication device which does not occlude the ear canal.

SUMMARY OF THE INVENTION

The present invention relates to a two-way communication earpiece which is configured to be received behind the ear of a user with a sound delivery tube extending into the ear canal.

In accordance with one aspect of the present invention, a two-way communication earpiece includes an earpiece case configured to be received behind the ear of a user, a cable for transmitting electronic signals from a communication device to the earpiece case, and a sound transducer within the earpiece case for receiving electronic signals and emitting sound based on the electronic signals. A sound transmission tube has a first end acoustically connected to the sound transducer and a second end configured to extend into the ear canal of the user. A microphone is positioned on the earpiece case at a location above the ear of the user for sound pickup.

A pre-amplifier is provided for amplification of electronic signals provided by the microphone. The pre-amplifier is powered by the communication device through the cable.

In accordance with an additional aspect of the present invention, a two-way communication device includes a remote communication device having a standard three terminal audio jack and a two-way earpiece configured to be positioned behind the ear of the user. The two-way earpiece includes a case having a sound processor, a speaker, and a microphone contained therein. A cable connects the two-way earpiece to the audio jack of the remote communication device. A sound transmitting tube has a first end acoustically connected to the speaker within the earpiece case and a second end configured to extend into an ear canal.

In accordance with a further aspect of the invention, a two-way communication device earpiece includes an earpiece case configured to fit behind and extend over a top of an ear of a user, a sound delivery tube with a non-occluding eartip connected to the earpiece case for transmitting sounds from the earpiece case to an ear canal of the user, a sound transducer within the earpiece case for emitting sounds, a microphone within the earpiece case for receiving sounds, a sound processor for processing signals representing sounds, and signal transmitting means for transmitting signals representing sounds to and from the earpiece case.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

Figure 1:
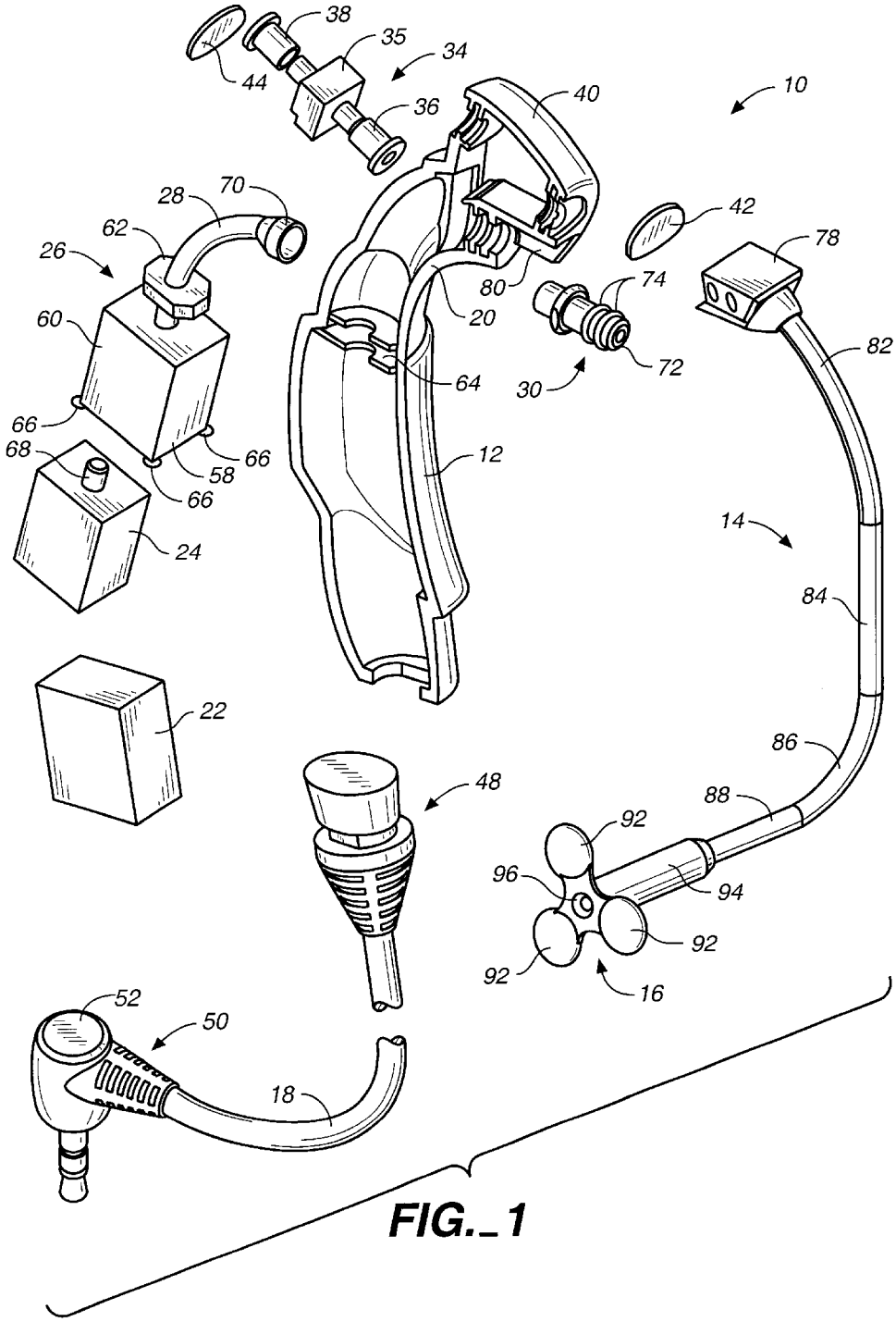
FIG. 1 is an exploded perspective view of a two-way communication earpiece according to the present invention.
Figure 2:
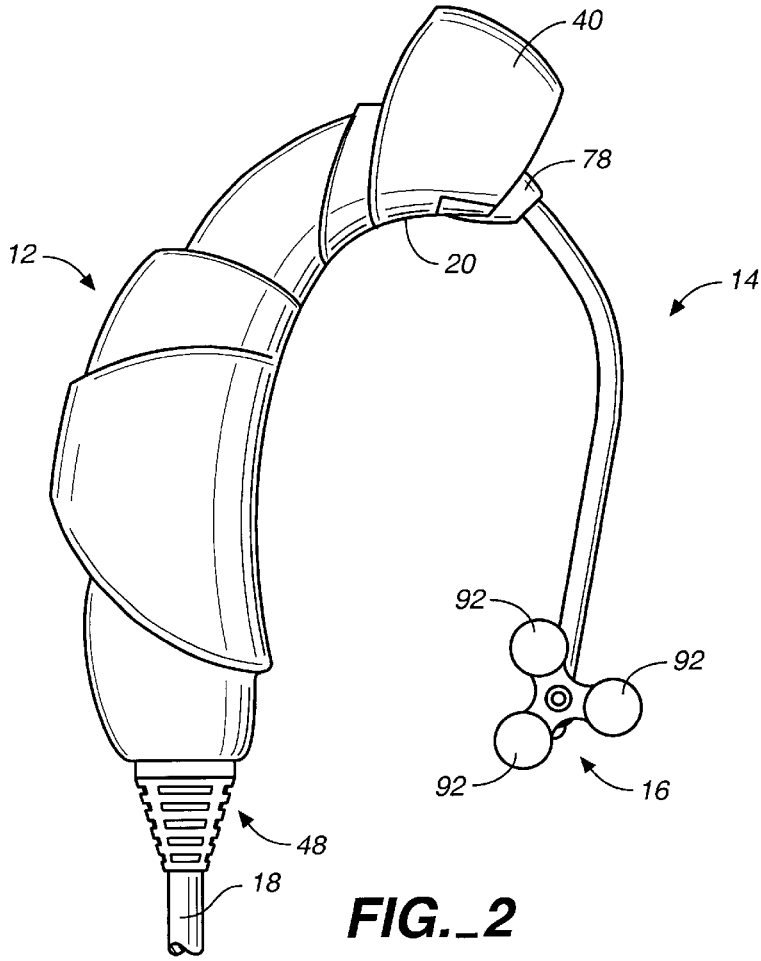
FIG. 2 is an assembled side view of the two-way communication earpiece of FIG. 1.

A two-way communication earpiece 10 according to the present invention provides sound delivery and sound pickup in a small, comfortable, and inconspicious device. The communication earpiece 10 may be connected to any two-way communication system such as a telephone, cellular telephone, or two-way radio, or connected to a one-way communication device, such as, a radio, tape player, CD player, television, high fidelity system, or the like. The two-way communication earpiece 10 includes an earpiece case 12 configured to be received behind the ear of a user. One half of the earpiece case is illustrated in FIG. 1. The earpiece 10 includes a sound delivery tube 14 extending from the earpiece case into the ear canal. An eartip 16 is positioned at the end of the sound delivery tube 14 which extends into the ear canal. An electrical cable 18 is provided to connect the earpiece 10 to a communication device such as a telephone or radio.

The cable 18 includes a first end 48 for connection to the earpiece case 12 and a second end 50. The second end 50 of the cable 18 is provided with a standard three terminal audio plug 52 for connection to a standard three terminal jack 104 of a communication device 100. The audio plug 52 has three electrical contacts including contacts for signal transmitting, signal receiving, and ground. The audio plug 52 may be a standard 2.5 mm stereo plug which is known to be used for radio, telephone, and other earphones and headsets. Although the audio plug 52 is designed to be used with two-way devices it can also be used with one-way devices in which case one of the signal contacts will be shorted out in the jack. The electrical cable 18 allows two-way communication to be transmitted from a remote communication device to and from the earpiece 10. The communication device to which the earpiece 10 is connected by the cable 18 may be a fixed device or a portable device which may be worn on the person. Although the invention has been illustrated with a cable 18 for connection to external electronics, the cable may be omitted for certain devices and a wireless link may be used.

The earpiece case 12 is configured to be received and substantially concealed behind the ear of the user. An upper portion 20 of the earpiece case 12 and a portion of the sound delivery tube 14 curve over the ear of the user and together act as an ear hook to support the earpiece case 12 comfortably on the ear.

Figure 5:
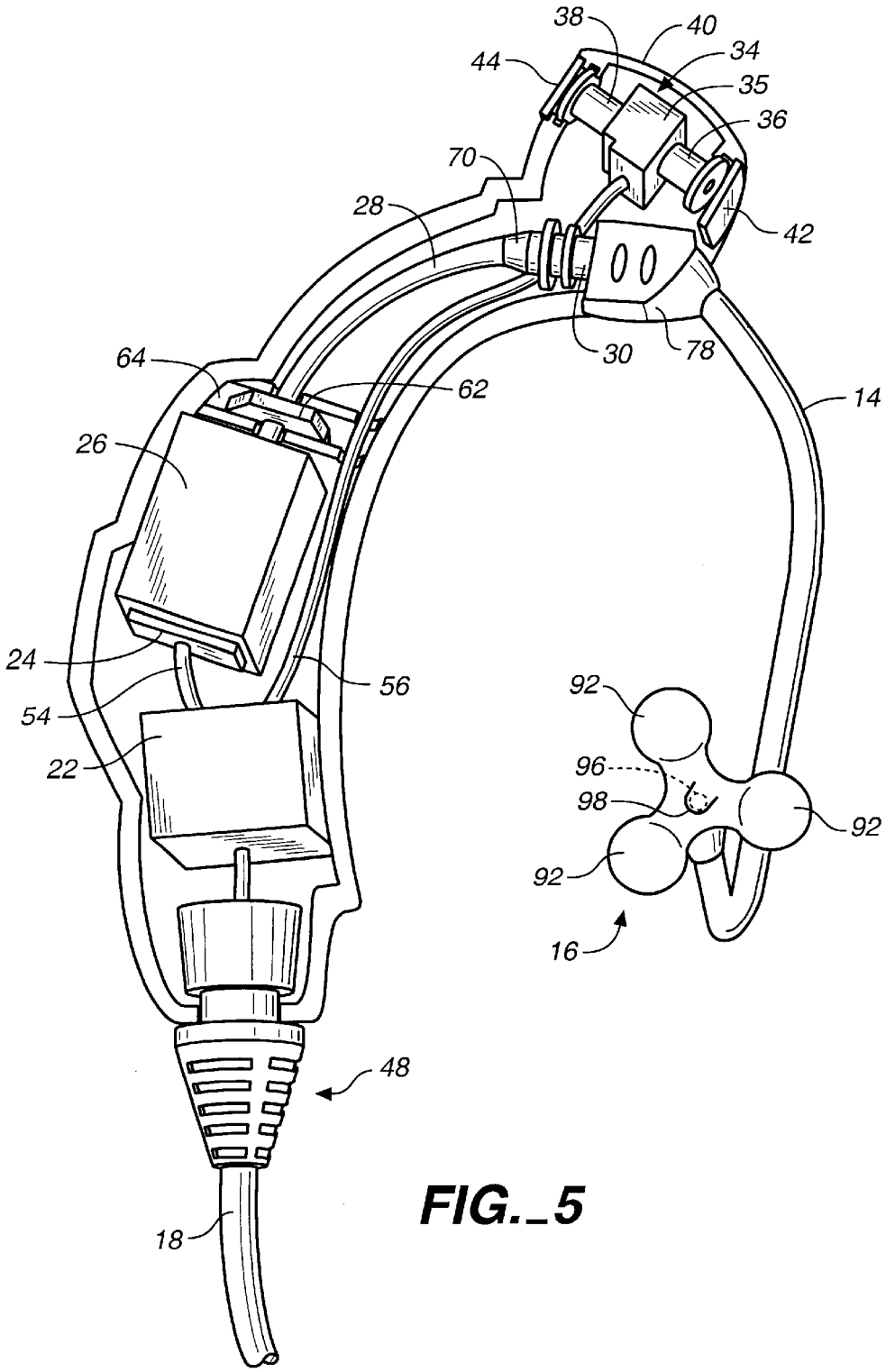
FIG. 5 is a perspective view of the two-way communication earpiece with one half of the earpiece case removed.

The earpiece case 12 contains a printed circuit board 22, a sound transducer 24, a mid-tube assembly 26, and a microphone assembly 34. The printed circuit board 22 incorporates the electronic components of the sound delivery and/or voice pickup systems. As illustrated in FIG. 5, the printed circuit board 22 is connected by a first electrical connection 54 to the sound transducer 24 and by a second electrical connection 56 to the microphone assembly 34.

Figure 8:
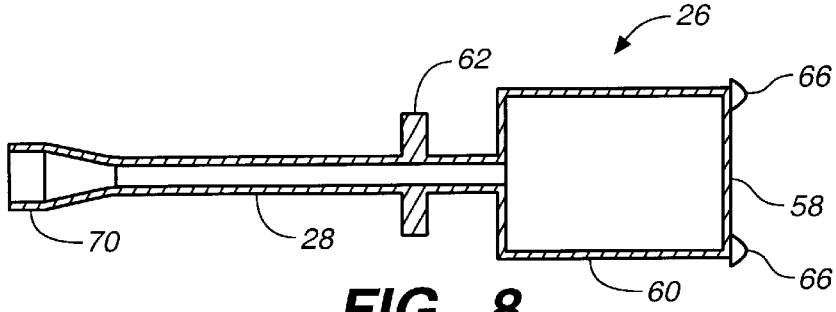
FIG. 8 is a side cross sectional view of the midtube assembly.

The mid-tube assembly 26, as illustrated in FIG. 1 and in the cross sectional view of FIG. 8, includes a rectangular housing 60 connected to a sound transmission tube 28. The rectangular housing 60 is configured to receive the sound transducer 24 from an open end 58 and to support the sound transducer within the earpiece case 12. The mid-tube assembly 26 is formed of a resilient material, such as rubber, which isolates the sound transducer 24 and prevents vibration of the sound transducer from being passed through the earpiece case 12 to the microphone assembly 34.

The mid-tube assembly 26 includes a flange 62 on the sound transmission tube 28. The flange 62 is received in a corresponding slot 64 in the earpiece case 12 to hold the mid-tube assembly 26 in place. The rectangular housing 60 also includes four conical bumpers 66 which prevent the sound transducer 24 from colliding with the case 12 if the device is dropped.

When the sound transducer 24 is received within the mid-tube assembly 26 a sound output tube 68 of the sound transducer delivers sound directly into the sound transmission tube 28 of the mid-tube assembly. An opposite end 70 of the sound transmission tube 28 is secured to a connector 30. An engagement end 72 of the connector 30 protrudes from the earpiece case 12 for connection to the sound delivery tube 14. The engagement end 72 of the connector 30 includes one or more annular ridges 74 having substantially hemispherical cross sections for providing an acoustic seal with a corresponding connector of the sound delivery tube 14.

The sound delivery tube 14 includes a substantially trapezoidal connector 78 for connection to the earpiece case 12. The connector 78 includes a socket for receiving the engagement end 72 of the connector 30. The socket has interior grooves which correspond to the ridges 74 on the exterior of the connector 30. In addition, the trapezoidal connector 78 has an external surface which is received in a socket portion 80 of the earpiece case 12 in only one orientation.

The trapezoidal connector 78 of the sound delivery tube 14 and the connector 30 of the earpiece case 12 provide a snap-fit connection which allows the sound delivery tube 14 to be easily replaced and disposed of. This snap-fit connection is particularly advantageous for applications where multiple users use the same communication earpiece 10 and the sound delivery tube 14 and eartip 16 are periodically replaced.

Although the present invention has been described as including a connector 78 which snaps over the connector 30 of the earpiece case, it should be understood that a sound delivery tube connector may alternatively be fitted inside a sound output connector of the earpiece. Further, the coupling may be provided with one or more grooves and correspondingly shaped rings to form the acoustic seal. The coupling between the sound delivery tube 14 and the earpiece case 12 may be any known removable coupling or may be a permanent coupling.

The sound delivery tube 14 has a first bend 82, a first straight segment 84, a second bend 86 and a second straight segment 88. The first bend 82 and the second bend 86 lie in planes which are substantially perpendicular to one another. The sound delivery tube 14 is provided in both left and right ear configurations allowing the device to be switched between the left and right ears by replacing the sound delivery tube. The tube 14 is preferably formed of a transparent plastic material which is nearly invisible in use. The tube 14 may be formed by overmolding the eartip 14 and the trapezoidal connector 78 onto the ends of the tube and shaping the tube into right and left ear versions.

The eartip 16 illustrated in the figures is a flower-shaped eartip formed of a resilient material which includes three flower petals 92 extending from a base 94. A sound output opening 96 is provided at the center of the flower-shaped eartip 16 for delivering sound from the communication earpiece 10. The eartip 16 retains the end of the sound delivery tube 14 in position within the user's ear canal by engaging the walls of the ear canal with the resilient petals 92 of the flower. The flower-shaped eartip 16 is only one example of an eartip which may be used with the present invention. Many other eartip shapes may also be used including the bud-shaped and guppie-shaped eartips illustrated in U.S. Provisional Patent Application Serial No. 60/053,031, filed on Jul. 18, 1997, which is incorporated herein by reference in its entirety. Other shapes and constructions of custom earmold tips and stock eartips may also be connected to the sound delivery tube 14 according to the present invention.

Figure 6:
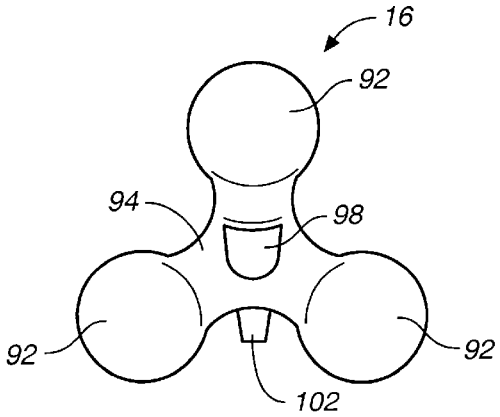
FIG. 6 is an end view of the flower-shaped eartip.
Figure 7:
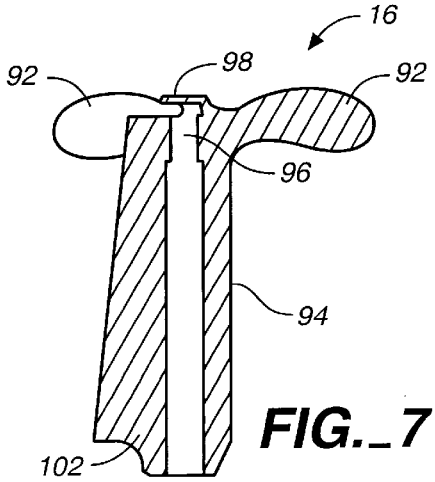
FIG. 7 is a side cross sectional view of the flower-shaped eartip.
Figure 3:
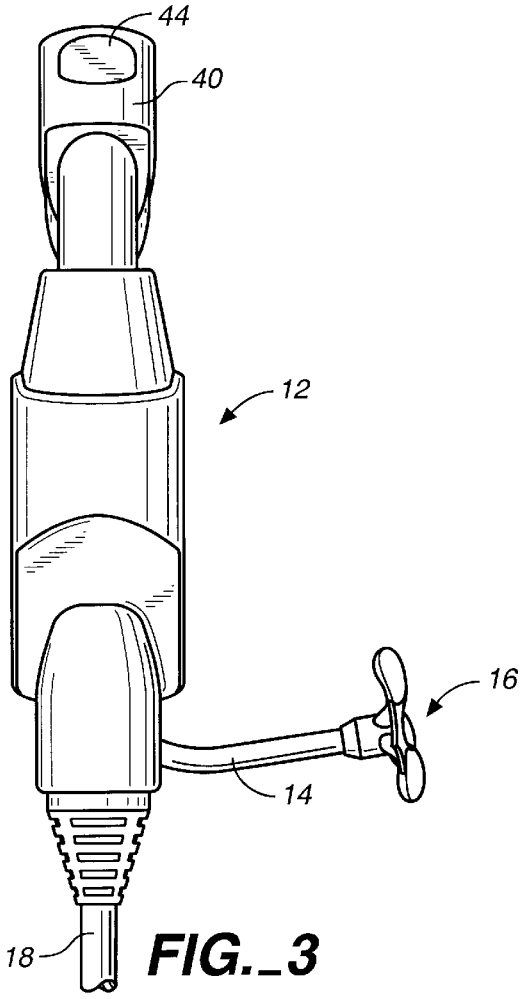
FIG. 3 is a rear view of the two-way communication earpiece.
Figure 4:
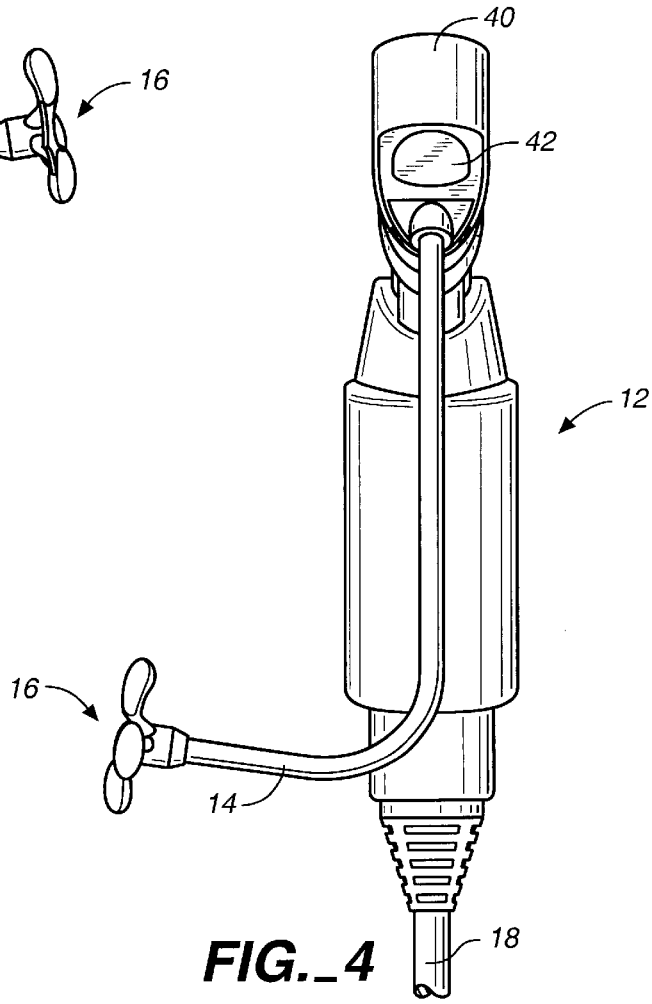
FIG. 4 is a front view of the two-way communication earpiece.

Preferably, the eartip 16 according to the present invention is an open ear canal eartip which does not occlude the ear canal and allows important ambient sounds to be transmitted through the ear canal around the eartip. As shown in FIGS. 5–7, the eartip 16 preferably includes a cerumen flap 98 which prevents cerumen from entering the sound output opening 96. The cerumen flap 98 is described in U.S. patent application Ser. No. 09/106,080, filed Jun. 29, 1998, which is incorporated herein by reference in its entirety. Alternately, any of the other known wax guards may be used.

The eartip 16 may also include a flange 102 at one side of the base 94. The flange 102 facilitates insertion of the eartip 16 into the ear canal by engaging the flange with a finger or fingernail.

In operation, electronic signals are delivered by the electrical cable 18 to the printed circuit board 22 of the earpiece where the signals are processed for transmission to the sound transducer 24. The sound processing may include, for example, frequency equalization of sounds to be delivered to the ear canal or other sound processing. Sounds are generated by the sound transducer 24 based on signals from the sound processor and delivered through the sound transmission tube 28 of the mid-tube assembly and the connector 30 to the sound delivery tube 14. The eartip 16 retains the ear tube 14 in place within the ear canal for delivery of sound directly to the ear canal.

Examples of open ear canal sound delivery systems including a frequency equalizer and a transducer for use in the two-way communication earpiece according to the present invention are described in detail in U.S. patent application Ser. No. 09/106,098, filed Jun. 29, 1998, which is incorporated herein by reference in its entirety.

The communication earpiece 10 also includes a sound pickup system including the microphone assembly 34 for voice pickup. The microphone assembly 34 includes a central microphone element 35 connected to front and back microphone suspension tubes 36, 38. The microphone element 35 and front and back microphone suspension tubes 36, 38 are contained within a microphone housing 40 which is positioned discretely above or just behind the ear of the user when the communication earpiece 10 is in use. The microphone element 35 is supported in the case by the microphone suspension tubes 36, 38 so that the microphone element does not touch the microphone housing 40 to isolate the microphone element from earpiece case vibrations.

One example of a directional microphone assembly 34 is described in detail in U.S. patent application Ser. No. 09/107,417, filed on Jun. 30, 1998, which is incorporated herein by reference in its entirety. Although the invention will be described for use with a directional microphone, an omni-directional microphone may also be used.

First and second protective membranes 42, 44 are positioned over the openings in the microphone tubes 36, 38. The protective membranes reduce wind noise pickup and protect the microphone element 35 from water improving the performance of the microphone. The protective membranes 42, 44 may be adhesively bonded onto the earpiece case 12 or may be mounted in any other known manner. The protective membranes 42, 44 may be formed of a material such as polytetrafluoroethylene. An example of a protective membrane is described in U.S. patent application Ser. No. 09/108,565, filed Jul. 1, 1998, which is incorporated herein by reference in its entirety.

Figure 10:
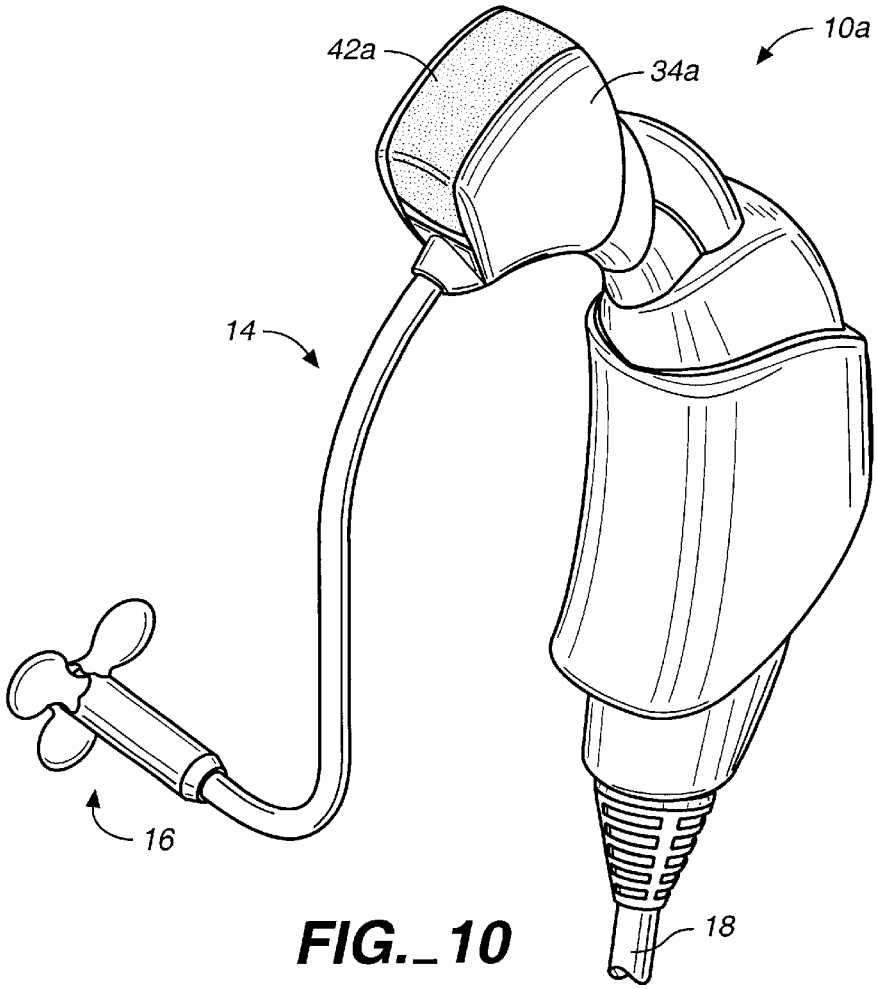
FIG. 10 is a perspective view of an alternative embodiment to the two-way communication earpiece.

FIG. 10 shows an alternative embodiment of a communication earpiece 10*a* having microphone assembly 34*a* in which the openings of the microphone tubes on opposite sides of the microphone assembly are covered by a continuous protective membrane 42*a*. The protective membrane 42*a* is an inverted U-shaped membrane which functions in the same manner as the first and second membranes 42, 44 of FIG. 1 to reduce wind noise pickup and protect the microphone element from water.

The microphone assembly 34 is connected by the second electrical connection 56 to a pre-amplifier 110 located on the printed circuit board 22. The output of the pre-amplifier 110 is transmitted through the electrical cable 18 of the earpiece 10 to the external communication device. The pre-amplifier 110 provides a voltage gain between the microphone element 35 and the communication device, such as a radio. In addition, the pre-amplifier 110 provides frequency compensation. Since the microphone output is generally not flat over all frequencies the pre-amplifier is used to flatten the response from the microphone for transmission to the communications device.

Figure 9:
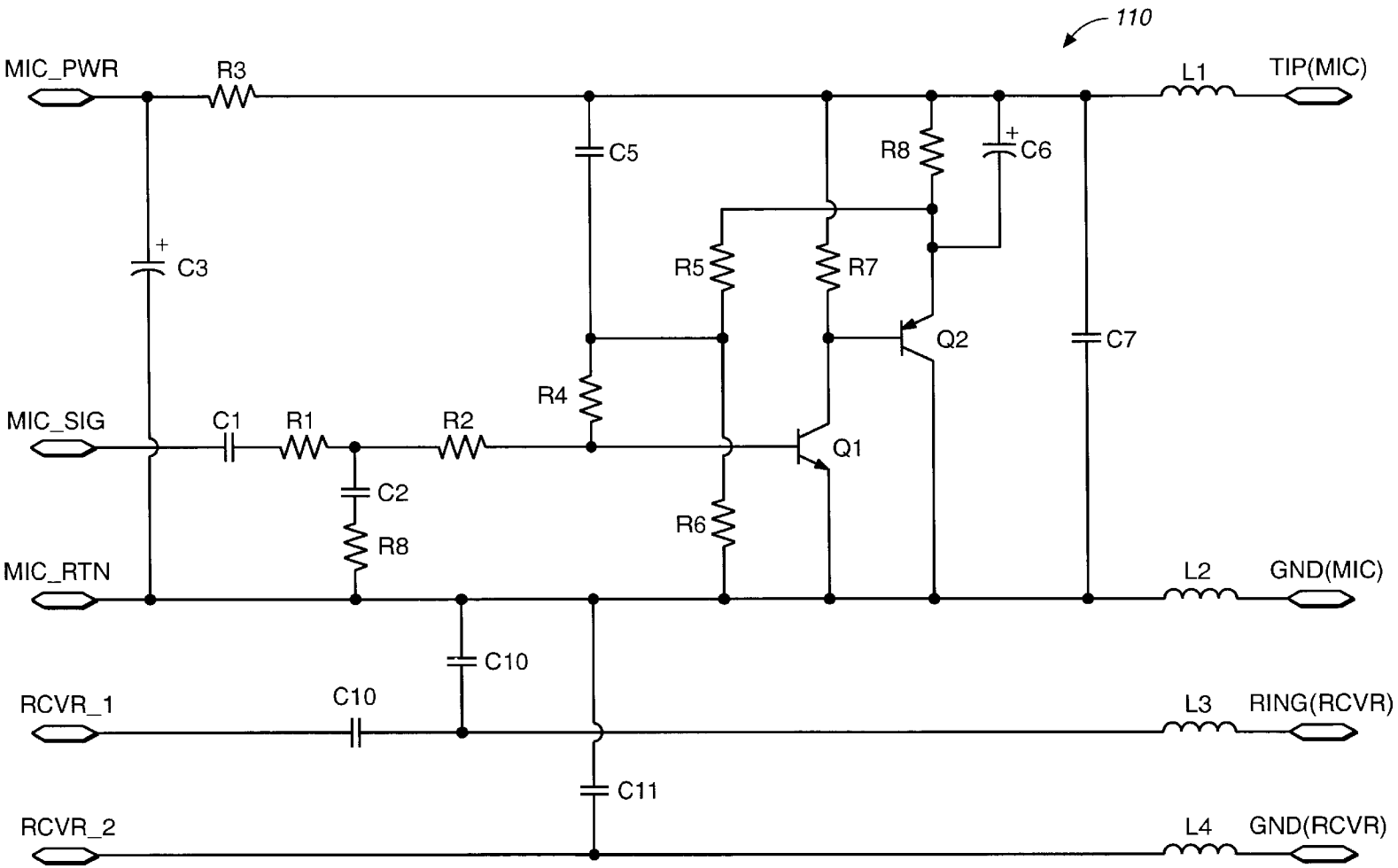
FIG. 9 is a schematic of a circuit diagram of one example of a low current preamp for the sound pickup system.

A circuit diagram for an exemplary pre-amplifier 110 for use in the present invention is illustrated schematically in FIG. 9. The pre-amplifier 110 is a simple discrete amplifier having only two transistors. The pre-amplifier 110 is designed to operate at low voltage and low current which is available from the standard three terminal audio jack to which the earpiece 10 is attached. For example, the standard 2.5 mm audio jack provides about 200 microamps and about 1 volt—of this about 150 microamps are used to power the pre-amplifier 110 and the other 50 microamps are used to power the microphone element 35. The pre-amplifier has an approximately 1 volt operating voltage and provides an output with low noise and low distortion. The pre-amplifier 110 illustrated in FIG. 9 is one example of a low voltage amplifier for use in the present invention. However, other pre-amplifier circuits may also be used without departing from the present invention as would be known to those in the art.

The pre-amplifier may be fabricated as an integrated circuit to decrease size and improve functionality. The sound pickup electronics may include any one or more of automatic gain control, compression amplification, noise cancellation amplification, and programmability circuits. The automatic gain control reduces system sensitivity at high sound levels to prevent distortion. The compression amplifier will increase system sensitivity at low sound levels. A noise cancellation amplifier accepts inputs from multiple sources and subtracts noise signals. Finally, a programmability circuit allows gain, frequency response, automatic gain control, and the like to be digitally programed for customized performance.

The sound pickup electronics according to the present invention provide good sound quality without the requirement for expensive sound equalization electronics or a battery incorporated in the earpiece. The sound quality output of the present invention is better than necessary for most two-way communication applications such as cellular and regular telephone communication and two-way radio communication.

The communication earpiece 10 according to the present invention utilizes low cost, simple microphone electronics which are incorporated within the earpiece to provide two-way communication. Power for the microphone 35 is delivered to the communication earpiece 10 from the external communication device through the cable 18. This eliminates the need for a battery within the communication earpiece 10. The elimination of the battery and simplification of microphone electronics allows the earpiece 10 to be small, lightweight, comfortable, discreet, and inexpensive.

The earpiece can be used for simplex, half-duplex, or full-duplex audio communications. Although the present invention has been described as a communication earpiece for use in the consumer electronics area it may also be used for other applications where one-way or two-way communication is needed.

The communication earpiece 10 can be modified for use as a hearing aid by adding a power source and connecting the output signal of the microphone element through appropriate processing circuits to the sound transducer.

While the invention has been described in detail with reference to the referred embodiments thereof, it will be apparent to one skilled in the art that various changes and modifications can be made and equivalents employed, without departing from the present invention.

What is claimed is:

1. A communication device earpiece comprising:

an earpiece case configured to fit behind and extend over a top of an ear of a user;

a sound delivery tube, wherein a first end of the sound delivery tube is coupled to the earpiece case and adapted for transmitting sounds from the earpiece case to an ear canal of the user;

a non-occluding eartip coupled to a second end of the sound delivery tube, the non-occluding eartip comprising:

an eartip base, the eartip base including a proximal end portion and a distal end portion;

an open, non-occluding tip member coupled to the distal end portion of the eartip base, the open, non-occluding tip member adapted to retain the sound delivery tube in position within the ear canal by engaging the ear canal at a first plurality of location and not engaging the ear canal at a second plurality of locations;

a flange coupled to the proximal end portion of the eartip base, the flange adapted to facilitate insertion of the eartip into the ear canal by engaging the flange with a finger or fingernail;

a sound transducer within the earpiece case for emitting sounds to the sound delivery tube;

a microphone within the earpiece case for receiving sounds;

a sound processor for processing signals representing sounds received from the microphone; and signal transmitting means for transmitting signals representing sounds to and from the earpiece case.

2. The communication device earpiece of claim 1, wherein said open, non-occluding tip member is comprised of a plurality of resilient members.

3. The communication device earpiece of claim 1, further comprising a cable adapted for transmitting electronic signals from a communication device to the communication device earpiece.

4. The communication device earpiece of claim 3, wherein the cable has a first end connected to the earpiece case and a second end coupled to an audio plug.

5. The communication device earpiece of claim 1, said sound processor further comprising a pre-amplifier for amplifying the signals.

6. The communication device earpiece of claim 1, wherein the two-way communication device earpiece operates in a full-duplex mode.

7. The communication device earpiece of claim 1, wherein the microphone is a directional microphone.

8. The communication device earpiece of claim 1, wherein the signal transmitting means further comprises a wireless transmitter and a wireless receiver.

* * * * *